US011716560B1

(12) United States Patent
Cretella et al.

(10) Patent No.: US 11,716,560 B1
(45) Date of Patent: Aug. 1, 2023

(54) WIRELESS HEADPHONE ACCESSORY

(71) Applicant: Apple Inc., Cupertino, CA (US)

(72) Inventors: Kristen L. Cretella, San Francisco, CA (US); Chad J. Miller, Oakland, CA (US); Daniel A. Podhajny, San Jose, CA (US); Joshua A. Hoover, Saratoga, CA (US); Nicholas R. Trincia, San Francisco, CA (US); Seul Bi Kim, Cupertino, CA (US); William Leith, San Francisco, CA (US); Yi Zou, Sunnyvale, CA (US); Yue Chen, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 17/219,180

(22) Filed: Mar. 31, 2021

Related U.S. Application Data

(60) Provisional application No. 63/083,748, filed on Sep. 25, 2020.

(51) Int. Cl.
*H04R 1/10* (2006.01)

(52) U.S. Cl.
CPC ..... *H04R 1/1025* (2013.01); *H04R 1/1016* (2013.01); *H04R 2420/07* (2013.01)

(58) Field of Classification Search
CPC . H04R 1/1025; H04R 1/1016; H04R 2420/07
See application file for complete search history.

(56) References Cited

U.S. PATENT DOCUMENTS

| | | | | |
|---|---|---|---|---|
| 10,506,324 | B2 | 12/2019 | Minoo et al. | |
| 2007/0258614 | A1* | 11/2007 | Langberg | H04R 1/1041 381/370 |
| 2010/0000054 | A1 | 1/2010 | Roser | |
| 2014/0120983 | A1* | 5/2014 | Lam | H04M 1/0283 455/557 |
| 2015/0333302 | A1* | 11/2015 | Johns | G04C 10/00 429/127 |

(Continued)

FOREIGN PATENT DOCUMENTS

| | | | |
|---|---|---|---|
| KR | 20180129724 | A | 12/2018 |
| WO | 2017007243 | A1 | 1/2017 |

OTHER PUBLICATIONS

AirPods Neck Straps, Case Mate, SKU CM039936-06, https://case-mate.com/products/neck-straps-airpods?variant=34102999875720&gclid=EAIalQobChMlsLTek5vk6wlVoj6tBh0Z9w2NEAkYBCABEgJUCfD_BwE, available at least as early as Feb. 25, 2021.

(Continued)

*Primary Examiner* — Jason R Kurr
(74) *Attorney, Agent, or Firm* — Dorsey & Whitney LLP

(57) ABSTRACT

An accessory for wireless earbuds can include a first receiving portion defining a first cavity sized to receive and retain a first earbud and a second receiving portion defining a second cavity sized to receive and retain a second earbud. Each receiving portion can include a charging component to electrically couple with the respective earbud. The accessory can include a flexible portion connected to the first receiving portion and the second receiving portion, the flexible portion at least partially defining an internal volume, and a battery disposed in the internal volume and electrically coupled with the charging components.

20 Claims, 13 Drawing Sheets

(56) References Cited

U.S. PATENT DOCUMENTS

| | | | | |
|---|---|---|---|---|
| 2016/0134961 | A1* | 5/2016 | Shaffer | H04R 1/105 381/74 |
| 2017/0094396 | A1 | 3/2017 | Chandramohan et al. | |
| 2018/0077479 | A1 | 3/2018 | Johanson | |
| 2018/0091887 | A1 | 3/2018 | Minoo et al. | |
| 2018/0103308 | A1* | 4/2018 | Boyajian | H04R 1/105 |
| 2018/0132026 | A1* | 5/2018 | Liang | H04R 1/1025 |
| 2018/0324515 | A1* | 11/2018 | Boesen | H04R 1/1041 |
| 2019/0116412 | A1* | 4/2019 | Prelogar | H04R 1/1016 |
| 2019/0273980 | A1* | 9/2019 | Hardi | H04R 1/1016 |
| 2020/0186908 | A1* | 6/2020 | Higgins | H04R 1/1025 |

OTHER PUBLICATIONS

Solid Silicone AirPods Case Cover Strap, SHEIN, SKU: sephacc18200619988, https://us.shein.com/Solid-Silicone-AirPods-Case-Cover-Strap-p-1332345-cat-2488.html?url from=adplasephacc182006199881-2&gclid=EAIalQobChMlici9gJvk6wlVfz6tBh16KQV3EAQYASABEgLNNPD_BwE, available at least as early as Feb. 25, 2021.

* cited by examiner

WIRELESS HEADPHONE ACCESSORY

CROSS-REFERENCE TO RELATED APPLICATION(S)

This claims priority to U.S. Provisional Patent Application No. 63/083,748, filed 25 Sep. 2020, and entitled "WIRELESS HEADPHONE ACCESSORY," the entire disclosure of which is hereby incorporated by reference.

FIELD

The described embodiments relate generally to accessories for electronic devices. More particularly, the present embodiments relate to accessories for wireless audio devices such as earbuds and headphones.

BACKGROUND

Recent advances in technology have driven electronic devices to encompass smaller form factors while providing increased battery life, performance, and durability. These attributes have contributed to electronic devices, such as smartphones, which are portable and provide instantaneous resources that enhance the daily activities of the user. While some portable electronic devices can be carried in a pocket or a purse, some activities do not permit the use of pockets or purses to store an electronic device. For example, some portable electronic devices are commonly used to listen to music while a user of the portable electronic device is jogging or otherwise exercising. Accessories for portable electronic devices having features to retain the portable electronic device to the user, however, are traditionally bulky and may be uncomfortable, or may not provide certain desired features, such as charging capabilities. Thus, improvements and advances to accessories for electronic devices can be desirable to reliably retain the electronic device in a convenient form factor while providing other desired features.

SUMMARY

According to some examples of the present disclosure, an accessory for a first and a second wireless earbud can include a first receiving portion defining a first cavity sized to receive the first wireless earbud, the first receiving portion including a first charging component, a second receiving portion defining a second cavity sized to receive a second wireless earbud, the second receiving portion including a second charging component, a flexible portion connected to the first receiving portion and the second receiving portion, the flexible portion at least partially defining an internal volume, and a battery disposed in the internal volume and electrically coupled with the first charging component and the second charging component.

In some examples, the first receiving portion includes a first magnet, the first charging component includes an electrical contact disposed in the first cavity, the second receiving portion includes a second magnet, the second charging component includes an electrical contact disposed in the second cavity, and the battery includes a flexible battery. In some examples, the first charging component is a first induction coil and the second charging component is a second induction coil. A polymer material can be molded over the flexible portion, the first receiving portion, and the second receiving portion. The flexible portion can have a substantially constant cross-sectional area. The flexible portion can also include a touch sensitive component. The flexible portion can also include a display.

In some examples, the flexible portion can include a first flexible section attached to the first receiving portion, the first flexible section including a first connector opposite the first receiving portion. A second flexible section can also be attached to the second receiving portion, the second flexible section including a second connector opposite the second receiving portion. The accessory can also include an extension component, the extension component including a first end including a third connector, a second end including a fourth connector, and a supplemental battery disposed in the extension component. The first receiving portion can also include an audio amplifier.

According to some examples, a wireless earbud charger can include a first end defining an earbud cavity, a charging component disposed in the first end, a first attachment feature connected to the first end, and a second end including a second attachment feature. In some examples, the first attachment feature can include a first magnet, and the second attachment feature can include a second magnet. The wireless earbud charger can further include a flexible portion electrically coupled with the charging component, the flexible portion including a battery. In some examples, the flexible portion further includes a display. Additionally, the charging component can include an inductive coil. The wireless earbud charger can also include an audio amplifier defined by the first end.

According to some examples, an accessory for wireless earbuds includes a first end defining a first earbud cavity, the first end including a first earbud charging component, a first magnetic coupler, and a first audio amplification feature. In some examples, the accessory further includes a second end defining a second earbud cavity, the second end including a second earbud charging component, a second magnetic coupler, and a second audio amplification feature. A battery can be electrically coupled with the first earbud charging component and the second earbud charging component.

In some examples, of the accessory, at least one of the first audio amplification feature or the second audio amplification feature can include a passive amplification feature. The accessory can also include a flexible portion disposed between the first end and the second end, the flexible portion including the battery. In some examples the accessory forms a loop when the first magnetic coupler is attached to the second magnetic coupler.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1A:
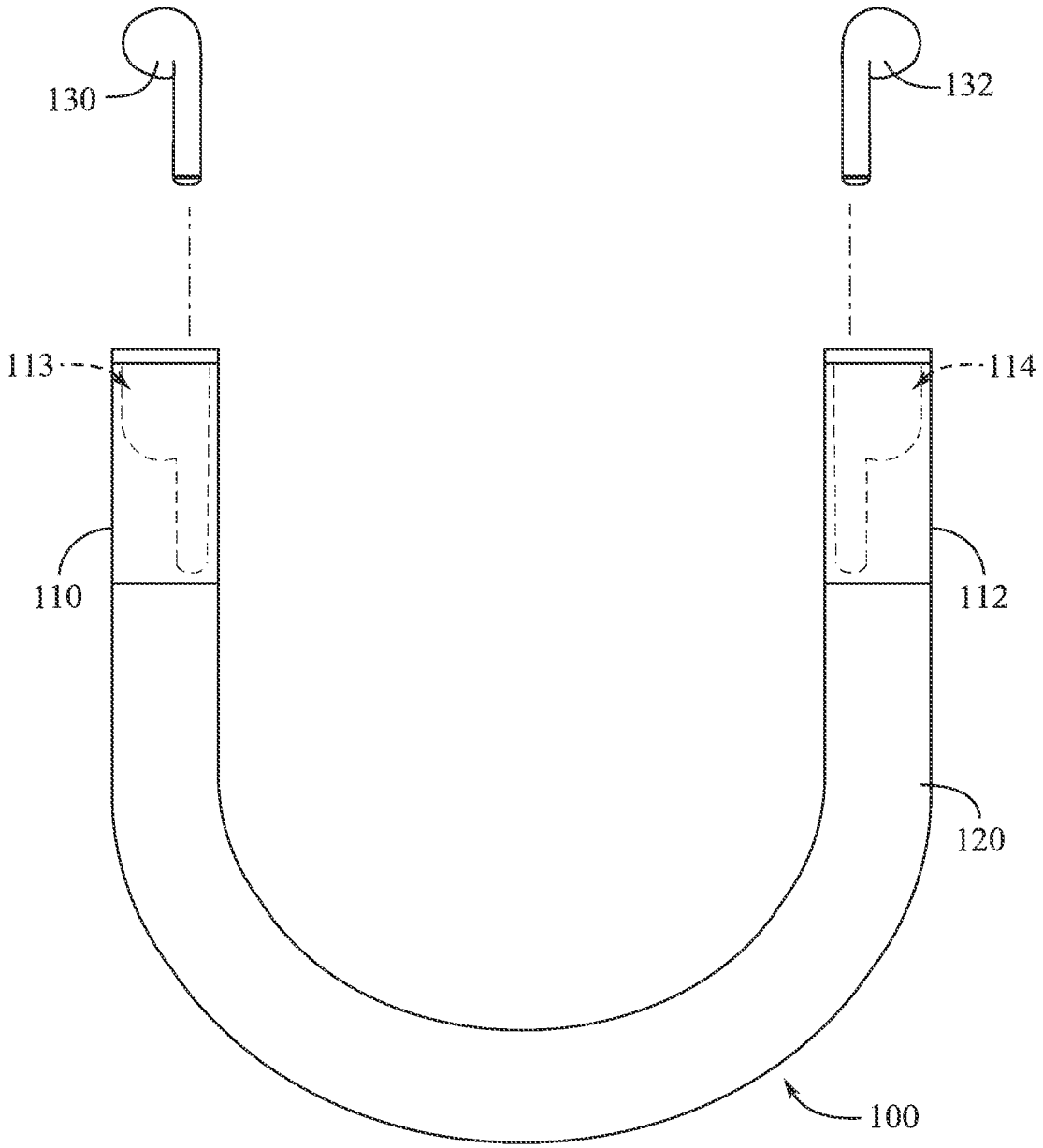
FIG. 1A shows a front view of an accessory and wireless earbuds.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments, as defined by the appended claims.

Portable electronic devices, such as smartphones, tablet computing devices, and smartwatches, have become commonplace and are increasingly used along with audio devices, including personal audio devices like headphones and/or earbuds to perform a variety of audio or acoustic functions. For example, a user can listen to music, conduct a telephone call, and even interact or command a portable electronic device through audio devices, such as wireless earbuds, that are paired or coupled to the portable electronic device. The wireless nature of such audio devices, however, often means that such devices rely on a battery for power during use. Further, such audio devices may be relatively small in size and may not be physically connected to one another. Accordingly, it can be desirable to store such devices in an accessory or other device.

Traditional accessories for audio devices, including accessories for wireless earbuds, can include a power supply or a battery that can be used to charge the earbuds when not in use. This can mean, however, that a user must not use the wireless earbuds in order to charge them. Accordingly, if a user is conducting a telephone call while the earbuds run out of battery, the user may need to stop or interrupt the call to recharge the earbuds. Thus, it can be desirable to provide an accessory that can recharge personal audio devices, such as wireless earbuds, while also allowing a user to continue using the personal audio device, or to use the accessory as an auxiliary or supplementary audio device.

Traditional accessories for electronic devices and audio devices can also have a form factor that allows the accessory to be stored in a user's pocket or bag. Some situations, however, can inherently prevent a user from retaining their portable electronic device on their persons (e.g., within a pants pocket or a purse). For example, some clothing, such as exercise clothing, can be devoid of pockets or otherwise inadequate to retain one or more portable electronic devices. Accordingly, it can be desirable for an accessory of one or more portable electronic devices to be attachable or securable to an object for storage both when in use and when not in use. In some examples, an accessory, as described herein, can be configurable between a first open state and a second closed state. In an open state, the accessory can be positioned adjacent to a desired object, such as a strap, a belt, or an appendage of a user, including a wrist or neck. The accessory can be manipulated into the closed state, for example to define a loop that can at least partially surround the object to retain the accessory thereon. In this manner, the accessories described herein can be ergonomically and conveniently stored in a variety of situations.

These and other embodiments are discussed below with reference to FIGS. 1-6C. However, those skilled in the art will readily appreciate that the detailed description given herein with respect to these Figures is for explanatory purposes only and should not be construed as limiting.

FIG. 1A shows a front view of an accessory 100 for one or more electronic devices, such as headphones or earbuds. In the present example, the accessory 100 can receive and retain one or more wireless audio devices, such as a pair of wireless earbuds 130, 132. Although various examples are described herein with respect to wireless earbuds, the principles, structures, and concepts described herein can apply to accessories for any form of electronic or audio devices as desired, including earbuds that can be physically connected to one another with a tether or wire. As used herein, the term wireless earbud is meant to be interpreted broadly to include any wireless ocular device that is designed to at least partially reside in a single ear of a user and to provide audio to the user.

As shown, the accessory 100 can include a first receiving portion 110 and a second receiving portion 112. The first and second receiving portions 110, 112 can be physically connected to one another by a housing portion 120. In some examples, some or all of the housing portion 120 can be flexible or bendable and can be referred to as a flexible portion 120. In some examples, however, the first and second receiving portions 110, 112 can be directly connected to one another, or can even be encompassed or at least partially contained within a housing or a portion of a housing.

The housing portion 120 or flexible portion 120 can at least partially define an internal volume and can contain one or more operational or electrical components at least partially within the internal volume. As used herein, the term operational component can refer to any component that provides, serves, or is capable of providing an electrical, magnetic, and/or mechanical function other than a merely structural or physical support. For example, the flexible portion 120 can define an internal volume and a power supply, battery, and processor or controller can be disposed in the internal volume. As described further herein, one or more of the operational or electrical components, such as a battery, can be electrically coupled with the first receiving portion 110 and/or the second receiving portion 112. Additionally, in the present example, the entire flexible portion 120 can be flexible or bendable. In some other examples, some or all of the flexible portion 120 can be relatively rigid, stiff, or inflexible as described herein.

The first receiving portion 110 can define a first cavity 113 that can be sized to receive and/or encompass at least a portion of the first earbud 130. In some examples, and as shown, the first cavity 113 can be sized to receive and/or encompass substantially the entire first earbud 130. The first receiving portion 110 can also include one or more retaining elements that can serve to removably retain the first earbud 130 in the first cavity 113. In some examples, a retaining element can include a mechanical retaining element and/or a magnetic retaining element. That is, in some examples a retaining element can include a latch, clip, clasp, interference fit, and/or other mechanical feature that can removably retain the earbud 130 in the first cavity 113. In some examples, the retaining element can include a magnetic retaining element. That is, the retaining element can include one or more permanent and/or electromagnets that can interact with one or more magnetic components of the first earbud 130 to removable retain the first earbud 130 in the cavity 113.

The second receiving portion 112 can be substantially similar to the first receiving portion 110 and can include some or all of the same features or components. The second receiving portion 112 can define a second receiving cavity 114 that can be sized to receive and/or encompass at least a portion of the second earbud 132. In some examples, where the first and second earbuds 130, 132 are substantially similar to one another but are mirror images of one another, the second receiving portion 112 and/or the second cavity 114 can be substantially similar to, but a mirror image of the first receiving portion 110 and/or the first cavity 113.

Although the examples described herein are illustrated with particular shapes, it should be understood that the accessories, earbuds, receiving portions, flexible portions, and/or cavities described herein are not limited to any particular shape, configuration, number, geometry, or arrangement. In some examples, accessories, earbuds, receiving portions, flexible portions, cavities, and/or other portions or components can have different shapes or configurations as desired. Further details regarding the accessory 100 are described with respect to FIG. 1B.

Figure 1B:
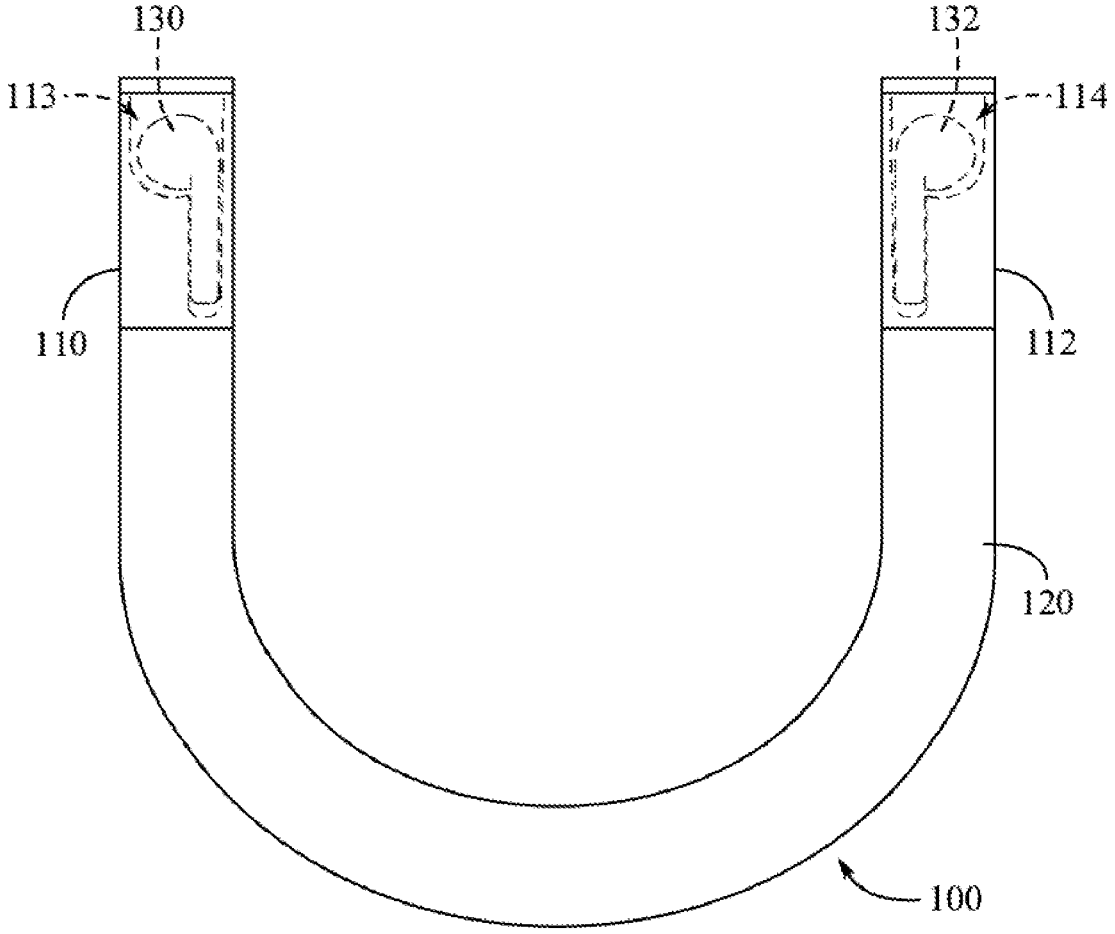
FIG. 1B shows a front view of the accessory of FIG. 1A with the wireless earbuds disposed therein.

FIG. 1B shows a front view of the accessory 100 with the first and second earbuds 130, 132 disposed and retained in the respective first and second cavities 113, 114. As described further herein, in some examples, the first and second receiving portions 110, 112 can each define an opening in communication with the respective first and second cavities 113, 114 and the ambient environment. In some examples, this opening can allow for the first and second earbuds 130, 132 to be inserted into the respective first and second cavities 113, 114 through the openings define by each of the first receiving portion 110 and second receiving portion 112. In some examples, some or all of the material of the first and second receiving portions 110, 112 can be compliant and/or deformable to allow for some or all of the first and second receiving portions 110, 112 to be bent or deformed so that a user can easily remove the earbuds 130, 132 from the cavities 113, 114.

In some examples, the cavities 113, 114 defined by the first and second receiving portions 110, 112 can entirely, or substantially entirely surround or encompass the first and second earbuds 130, 132. That is, no part of the earbuds 130, 132, may protrude from the first receiving portion 110 or the second receiving portion 112. In some examples, however, the first and second cavities 113, 114 may not entirely encompass the earbuds 130, 132, and thus at least a portion of the first earbud 130 and/or second earbud 132 may protrude from the respective first receiving portion 110 and/or second receiving portion 112.

As described herein, the first receiving portion 110 and the second receiving portion 112 can include retaining elements to removably retain the earbuds 130, 132 in their respective first and second cavities 113, 114. In some examples, the first receiving portion 110 can further include a charging component that can electrically couple with the first earbud 130 when the first earbud 130 is retained in the first cavity 113. In some examples, the charging component can include one, two, or any number of charging contacts. The charging contact or contacts can physically contact corresponding contacts disposed at an exterior surface of the earbud 130 to thereby make a direct electrical connection or coupling between the charging component and the earbud 130. The charging component can be electrically coupled to a power supply, battery, and/or other operational component of the accessory 100 and thus can serve to provide power and/or signals from the accessory 100 to the earbud 130, for example to charge the earbud 130.

In some examples, the charging component can be an inductive charging component and can include an induction coil. That is, in some examples, the charging component can inductively couple with the earbud 130, such as a corresponding induction coil in the earbud 130, to provide electrical power and/or signals to and/or from the earbud 130. In some examples, some or all of the charging component, including an induction coil thereof, can be positioned in an internal volume of the accessory that is at least partially defined by the flexible portion 120 and/or the first receiving portion 110.

In some examples, the second receiving portion 112 can be substantially similar to, and can include some or all of the features of the first receiving portion 110. Although, as described herein, in some examples the second receiving portion 112 can have a mirrored configuration as compared with the first receiving portion so as to correspond to the second earbud 132. Accordingly, the second receiving portion 112 can include a charging component. The charging component can include one, two, or more physical contacts, or can include an inductive charging component including an induction coil positioned to align with a corresponding induction coil of the second earbud 132. Further details regarding the accessory 100 are described with respect to FIG. 1C.

Figure 1C:
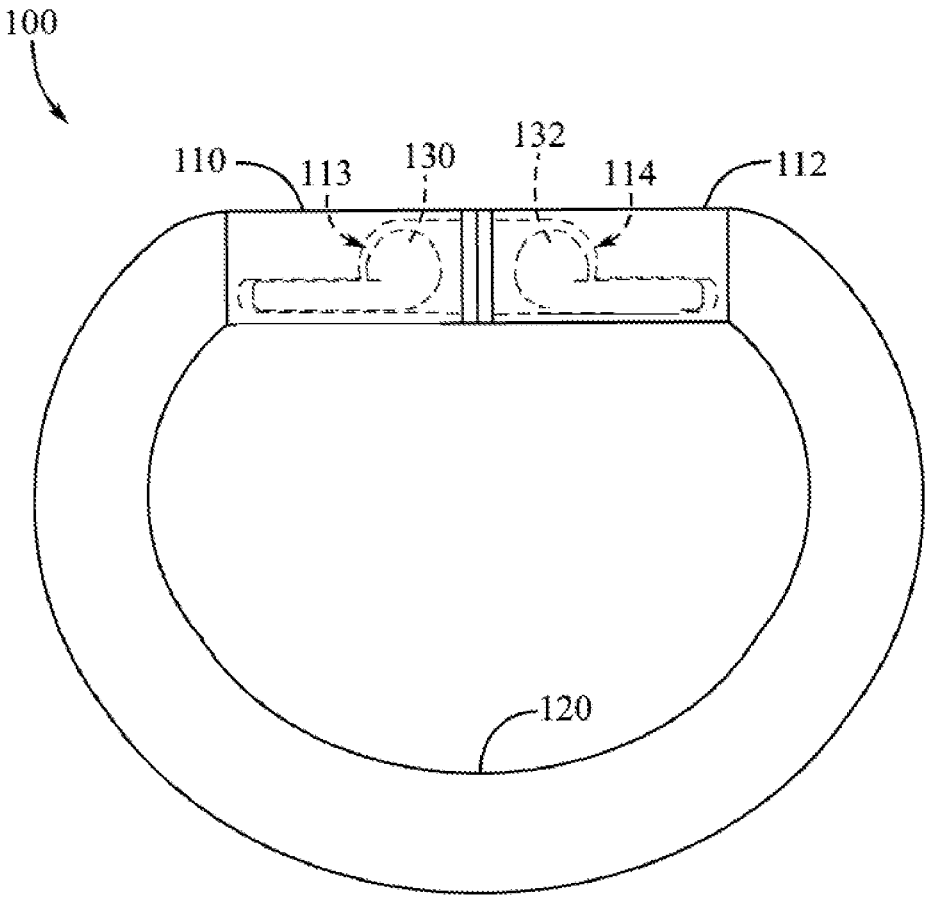
FIG. 1C shows a front view of the accessory of FIG. 1B in an alternate configuration.

FIG. 1C shows a front view of the accessory 100 in an alternate or closed configuration. As can be seen, in some examples, the first receiving portion 110 and the second receiving portion 112 can be removably attached, connected, or mated to one another so that the first receiving portion 110, second receiving portion 112, and flexible portion 120 define a loop having a central aperture or hole. In some examples, the first receiving portion 110 can be removably attached to the second receiving portion 112 so that each receiving portion occludes the cavity, or opening in communication with the cavity of the other receiving portion. That is, in some examples the first receiving portion 110 can occlude the opening defined by the second receiving portion 112 and the second receiving portion 112 can occlude the opening defined by the first receiving portion 110. Further, a periphery of the openings and/or cavities 113, 114 can be aligned with one another and the first cavity 113 can thus be in communication with the second cavity 114 when the accessory 100 is in the closed configuration. In this way, the earbuds 130, 132 disposed in the first and second receiving portion 110, 112 can be securely retained therein.

As can be seen, some or all of the flexible portion 120 can bend or flex to allow the first and second receiving portions 110, 112 to align and attach to each other in a desired manner. In some examples, some or all of the flexible portion 120 can be flexible and may not be self-supporting in a desired position. That is, if the flexible portion 120 is bent into a configuration and released, gravity can freely act to move the flexible portion 120 to a different position uncles the first and second receiving portions 110, 112 are attached to one another. In some examples, however, the flexible portion 120 can be self-supporting. That is, if a user bends the flexible portion 120 into a configuration or position, the flexible portion 120 will remain in that position until it is bent or moved again by the user. Accordingly, in some examples, the flexible portion 120 can act as a type of attachment feature if it is bent such that the first and second receiving portions 110, 112 align and/or contact one another.

In some examples, the accessory 100, for example the first and/or second receiving portions 110, 112 can include one or more attachment features that can removably attach the first and second receiving portions 110, 112 to one another. The attachment feature or features can include a mechanical attachment feature, a magnetic attachment feature, or substantially any components or features that can removably or releasably attach the first receiving portion 110 to the second receiving portion 112 as described herein. Further details regarding accessories including attachment features are described with respect to FIGS. 2A-2D FIG. 2A shows a perspective view of an accessory 200 that can be substantially similar to, and can include some or all of the features of the accessories described herein, such as accessory 100. As with accessory 100, the accessory 200 can be designed to receive and retain a pair of wireless earbuds 230, 232, although the concepts and structure described with respect to the accessory 200 can be used to receive and retain substantially any electronic device or multiple electronic devices as desired.

The accessory 200 can include a first receiving portion 210 that can define a first cavity 213 sized to receive and retain the first earbud 230. The accessory can also include a second receiving portion 212 that can define a second cavity 214 sized to receive and retain the second earbud 232. The first receiving portion 210 is connected or coupled to the second receiving portion 212 by a flexible housing portion 220.

The flexible portion 220 can include a relatively rigid or inflexible section 221. In some examples, as illustrated, the rigid section 221 can be located in the middle or center of the flexible portion 220 between the first and second receiving portions 210, 212. Although, in some other examples, the rigid section 221 can be located at any position, or multiple positions of the flexible portion 220. In some examples, the rigid section 221 can at least partially define an internal volume that can include one or more operational and/or electrical components. For example, the accessory 200 can include relatively inflexible components, such as one or more circuits, processors, or printed circuit boards, and these components can be disposed in the portion of the internal volume defined by the rigid section 221, while other flexible components may be disposed in other parts of the internal volume defined by the flexible portion.

The first receiving portion 210 can include a first attachment feature 223. In the present example, the first attachment feature 223 can be positioned at an end of the first receiving portion 210 opposite the part of the first receiving portion 210 that is connected to the flexible portion 220. As described with respect to FIG. 1B, and further herein, the first receiving portion 210 can define an opening in communication with the cavity 213 that can be sized to allow the first earbud 230 to pass through the opening into the cavity 213. In some examples, the attachment feature 223 can be positioned around all or at least some of the periphery of the opening and/or the periphery of the cavity 213.

In some examples, the attachment feature 223 can include magnetic material. That is, the attachment feature 223 can include one or more permanent and/or electromagnets. For example, the attachment feature 223 can include magnetic material that is formed into a shape corresponding to the periphery of the opening and/or cavity 213. In some examples, the attachment feature 223 can include one or multiple portions of magnetic material. In those examples where the attachment feature 223 includes magnetic material, the magnetic material can be coated or overmolded with a non-magnetic material, such as a polymer material. In some examples, the attachment feature 223 can be coated with the same material as the flexible portion 220 as described herein.

The attachment feature of the accessory 200 can include a second attachment feature 224 in addition to the first attachment feature 223. As with other features of the second receiving portion 212, the second attachment feature 224 can be substantially similar to the first attachment feature 223, but may have a mirrored shape or configuration. That is, the second attachment feature 224 can include a second magnet or second magnetic material that can be positioned or oriented such that it is magnetically attracted to the magnet or magnetic material of the first attachment features 223. Further details of alternate configurations of the accessory 200 and the first and second attachment features 223, 224 are described with respect to FIG. 2B.

Figure 2A:
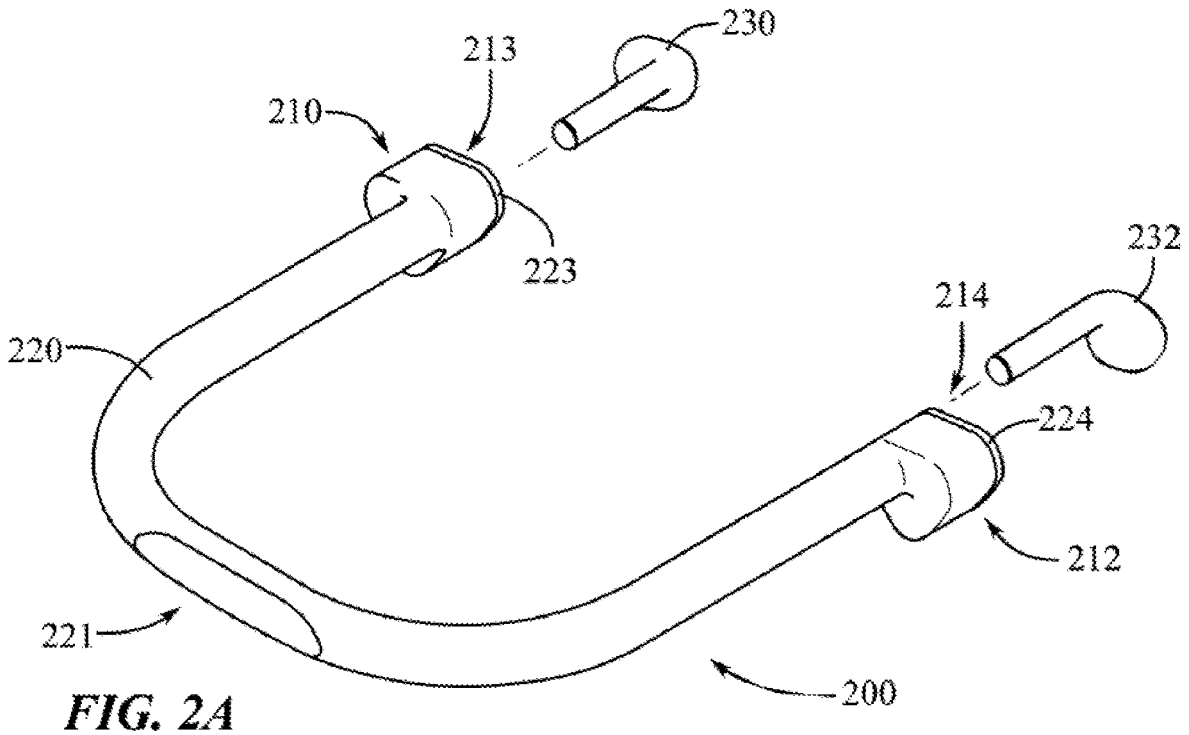
FIG. 2A shows a perspective view of an accessory and wireless earbuds.
Figure 2B:
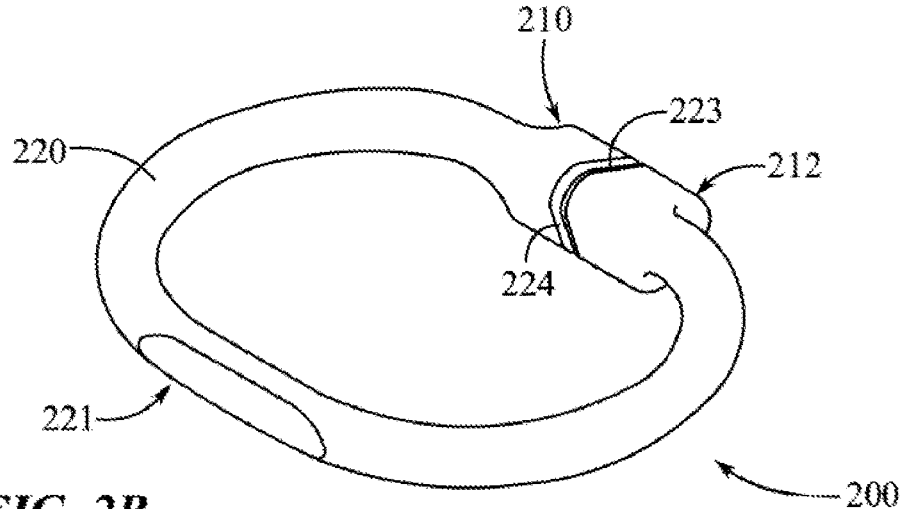
FIG. 2B shows a perspective view of the accessory of FIG. 2A in an alternate configuration.

FIG. 2B shows a perspective view of the accessory 200 in an alternate or closed configuration. As with the accessory 100 described with respect to FIG. 1C, the first receiving portion 210 and the second receiving portion 212 can be removably attached, connected, or mated to one another so that the first receiving portion 210, second receiving portion 212, and flexible portion 220 define a loop having a central aperture or hole. The first attachment feature 223 can align and removably couple or connect to the second attachment feature 224.

The first receiving portion 210 can be removably attached to the second receiving portion 212 so that each receiving portion occludes the cavity, or opening in communication with the cavity of the other receiving portion. A periphery of the openings and/or cavities 213, 214 can be aligned with one another and the first cavity 213 can thus be in communication with the second cavity 214 when the accessory 200 is in the closed configuration. In this way, the earbuds 230, 232 disposed in the first and second receiving portions 210, 212 can be securely retained therein.

In some examples, the flexible portion 220, including the rigid section 221, as well as some or all of the first receiving portion 210 and the second receiving portion 212 can include a relatively soft and/or compliant material that can at least partially define an exterior surface of the accessory 200. In some examples, the compliant material can include one or more polymers. In some examples, the compliant material can include silicone and/or silicone rubber. Further, in some examples, the compliant material can be overmolded around some or all of the flexible portion 220, including the rigid section 221, as well as some or all of the first receiving portion 210 and the second receiving portion 212. Further details regarding the accessory 200, including the operational components thereof are described with respect to FIG. 2C.

Figure 2C:
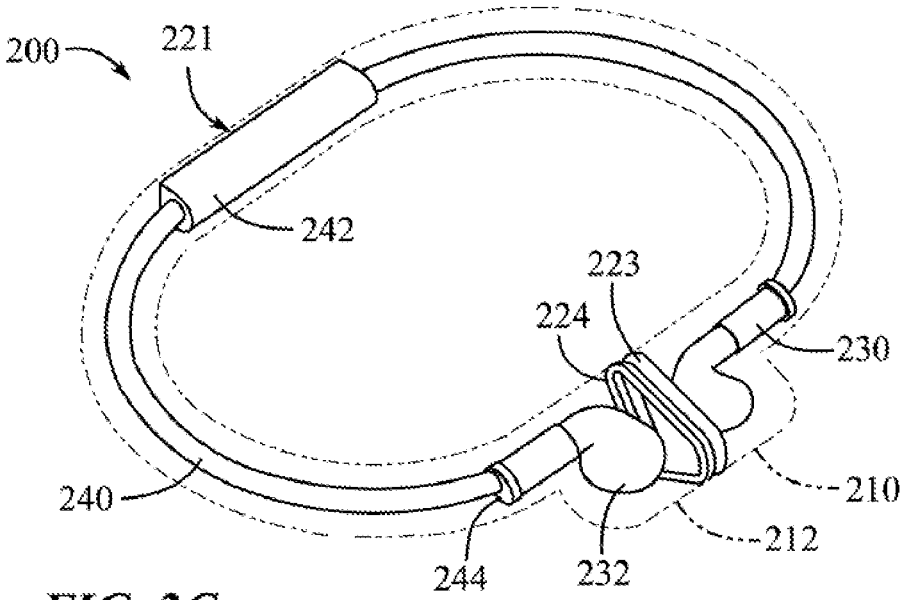
FIG. 2C shows a perspective view of components of the accessory of FIG. 2A.

FIG. 2C shows a perspective view of the accessory 200, including operational components disposed in an internal volume at least partially defined by the flexible portion 220. The flexible portion 220 itself is shown in dashed lines. In some examples, the accessory 200 can include at least one charging component 244 that can be positioned in the flexible portion 220 and/or one or both of the first receiving portion 210 and the second receiving portion 212. In the present examples, the charging component 244 can be positioned in the accessory 200 such that an end of the earbud 232 can contact, abut, or be positioned substantially near or adjacent to the charging component 244 to electrically couple therewith as described herein. Accordingly, the charging component 244 can provide power to the earbud 232, for example to charge or recharge the earbud 232 as desired. The accessory 200 can also include a second charging component The charging component 244 itself can be electrically coupled with a battery 240. In some examples, the battery 240 is disposed in the internal volume at least partially defined by the flexible portion 220. Further, the battery 240 can have a shape that can be substantially similar to, or correspond to a shape of the flexible portion and/or the internal volume defined by the flexible portion. For example, as shown, where the flexible portion 220 can have a substantially tubular or cylindrical shape, the battery 240 can also have a substantially tubular or cylindrical shape. In some examples, the battery 240 can be a flexible battery. That is, the battery 240 can be bent or flexed without damaging the battery 240. In some examples, the battery 240 can include one or more rigid or inflexible cells or portions that are connected by flexible components, to thereby allow the entire battery assembly 240 to flex even if some portions of it may not be flexible themselves. Additionally, in some examples, the flexible portion 220 can include or define a substantially constant cross-sectional area.

It will be understood that the term battery, as used herein, relates not only to a single battery cell but also to a group of batteries used in series or parallel, or a combination of both. Further, although certain examples described herein may only refer to a single battery, it will be understood that the accessories and devices described herein can include multiple batteries connected in series or parallel, or a combination of both.

Figure 2D:
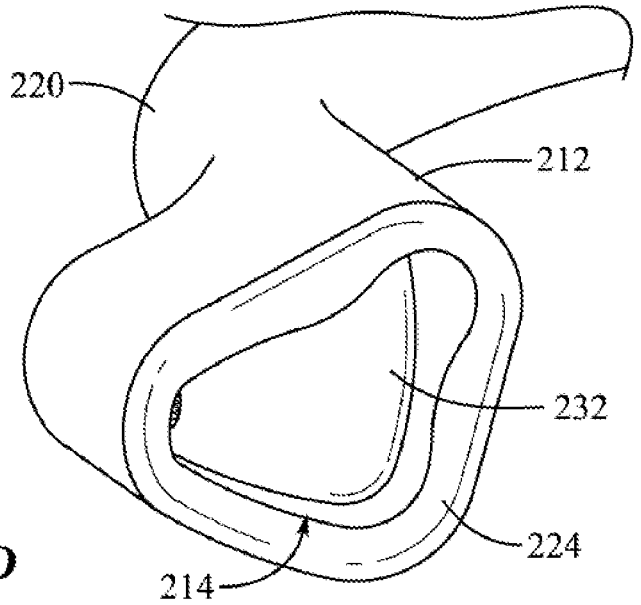
FIG. 2D shows a close-up view of a portion of the accessory of FIG. 2A.

The accessory 200 can also include a power supply 242 that can be electrically coupled with the one or more batteries 240 of the accessory 200. In some examples where the flexible portion 220 includes a rigid section 221, the power supply 242 can be positioned in the part of the internal volume at least partially defined by the rigid section 221. In some examples, the power supply 242 can be electrically coupled with the one or more charging components 244 of the accessory, for example through the battery 240 as shown. In some examples, the power supply 242 can include an inductive charging component, such as an induction coil. The induction coil of the power supply 242 can allow for the battery 240 to be charged when the power supply 242 is electrically and/or inductively coupled with a power source, such as a charging component, or other electronic device. In some examples, however, the power supply can include a physical port, such as a lighting port and/or USB-C port that can be in communication with the ambient environment, for example through an aperture or hole defined by the flexible portion 220 and/or rigid section 221. The accessory 200 can also include other operational components, for example one or more processors, controllers, wireless communication components disposed in the internal volume defined by the flexible portion 220 and/or rigid section 221. In some examples, the wireless communication components can be in communication with, and send and/or receive signals to and from the wireless earbuds 230, 232. The wireless communication component or components can operate over any frequencies or standards as desired, including Bluetooth, UWB, NFC, LTE, and/or Wi-Fi. Further details regarding the accessory 200 and the second receiving portion 212 are described with respect to FIG. 2D FIG. 2D shows a close-up view of the second receiving portion 212 of the accessory 200, including the second earbud 232 disposed in the cavity 214 defined by the second receiving portion 212. As described herein, the second receiving portion 212 can include a second attachment feature 224 that can itself include magnetic material. The magnetic material can be disposed at least partially around a periphery of the cavity 214 and/or an opening in communication with the cavity 214. Further, as described herein, the flexible portion 220 and the second receiving portion 212 can be overmolded with a compliant material, such as a polymeric material. In some examples, the polymeric material can include silicone. In some examples, the second attachment feature 224 can be overmolded with the same or a similar compliant material as the flexible portion 220 and/or the second attachment feature 224. In some examples, however, the second attachment feature 224 can include a different material. In some examples, this material can serve to seal against the corresponding first attachment feature of 223. In some examples, the material defining the exterior surface of the second attachment feature 224 can be the same as the material that overmolds the flexible portion 220 and/or the second retaining portion 212, but can have a different color and/or texture. Further, some or all of the attachment feature 224 and/or second receiving portion 212 can be compliant or bendable to allow a user to deform the attachment feature 224 and/or second receiving portion 212 to easily remove the earbud 232 from the cavity 214. Additional details regarding the exteriors and various features of accessories are described with respect to FIGS. 3A-3E.

Figure 3A:
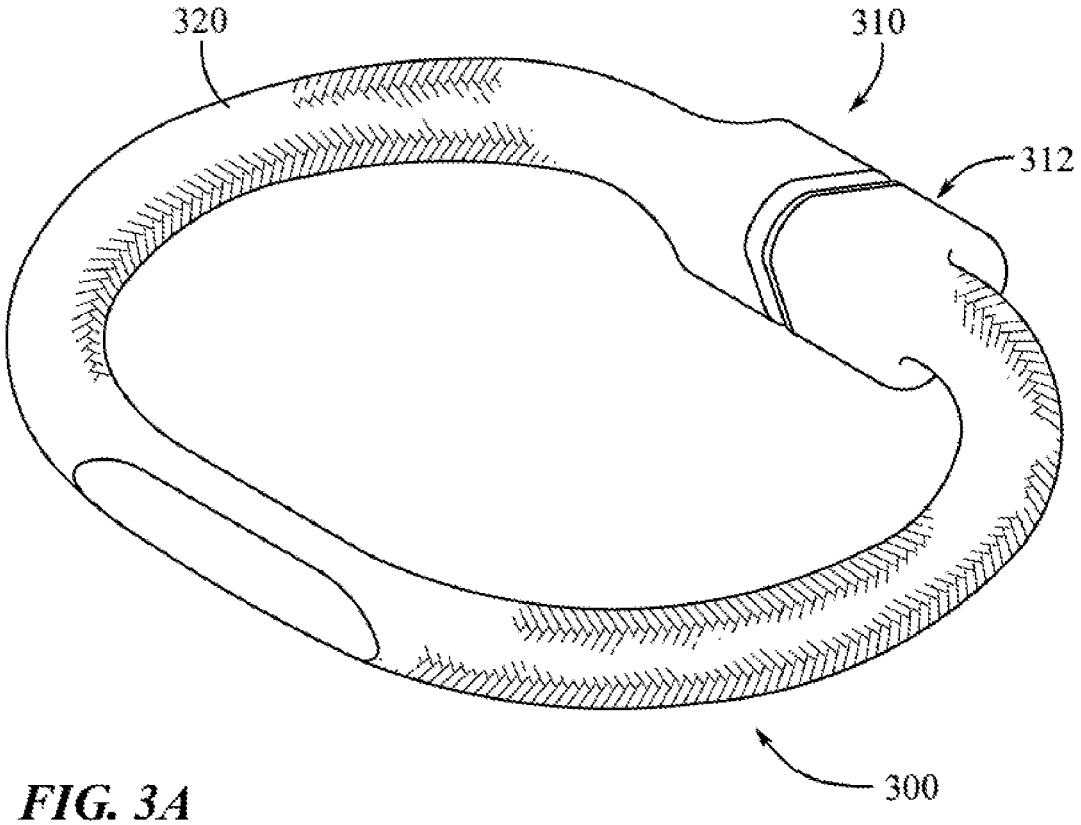
FIG. 3A shows a perspective view of an accessory for wireless earbuds.

FIG. 3A shows a perspective view of an accessory 200 that can be substantially similar to, and can include some or all of the features of the accessories described herein, such as accessories 100 and 200. As with accessory 100, the accessory 300 can be designed to receive and retain a pair of wireless earbuds, although the concepts and structure described with respect to the accessory 300 can be used to receive and retain substantially any electronic device or multiple electronic devices as desired.

The accessory 300 can include a first receiving portion 310 that can define a first cavity sized to receive and retain the first earbud. The accessory can also include a second receiving portion 312 that can define a second cavity sized to receive and retain the second earbud. The first receiving portion 310 is connected or coupled to the second receiving portion 312 by a flexible housing portion 320. As with the flexible portion 220, the flexible portion 320 can define an internal volume and one or more operational and/or electrical components can be disposed therein.

In some examples, the flexible portion 320, as well as some or all of the first receiving portion 310 and the second receiving portion 312 can include a relatively soft and/or compliant material that can at least partially define an exterior surface of the accessory 300. In some examples, and as shown, the accessory 300 can include a fabric, textile, cloth, woven, and/or knitted material that can at least partially define the exterior surface of the accessory 300. In some examples, the fabric or woven material can substantially encompass or surround the flexible portion 320, as well as some or all of the first receiving portion 310 and the second receiving portion 312. In some examples, the material can include leather, natural fabrics, synthetic fabrics, combination natural and synthetic fabrics, or combinations thereof. In some examples, the fabric exterior of the accessory 300 can provide a user with a comfortable experience when interacting with or touching the accessory 300, such as when wearing the accessory 300 as described further herein. Further details of an accessory 400 are described with respect to FIG. 3B.

Figure 3B:
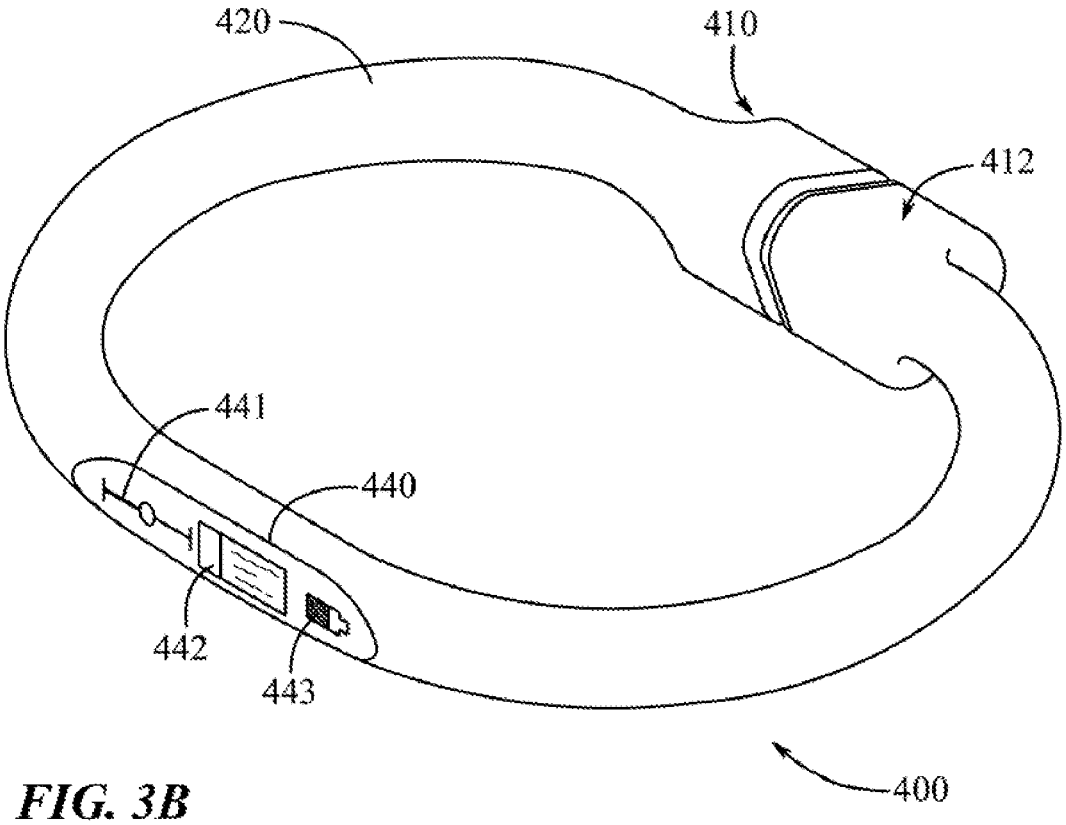
FIG. 3B shows a perspective view of an accessory for wireless earbuds.

FIG. 3B shows a perspective view of an accessory 400 that can be substantially similar to, and can include some or all of the features of the accessories described herein, such as accessories 100, 200, 300. As with accessory 100, the accessory 400 can be designed to receive and retain a pair of wireless earbuds, although the concepts and structure described with respect to the accessory 400 can be used to receive and retain substantially any electronic device or multiple electronic devices as desired.

The accessory 400 can include a first receiving portion 410 that can define a first cavity sized to receive and retain the first earbud. The accessory can also include a second receiving portion 412 that can define a second cavity sized to receive and retain the second earbud. The first receiving portion 410 is connected or coupled to the second receiving portion 412 by a flexible housing portion 420. As with the flexible portion 220, the flexible portion 420 can define an internal volume and one or more operational and/or electrical components can be disposed therein.

In some examples, the accessory 400 can include a display component 440 positioned at the exterior surface of the accessory 400. In some examples, the display component 440 can be part of, disposed on or in the flexible portion 420. For example, the display component 440 can be disposed at a central region of the flexible portion 420 opposite the first and second receiving portions 423, 424. In some examples, some or all of the display component 440 can be at least partially disposed in the internal volume defined by the flexible portion 420 and can be operatively and/or electrically coupled with one or more other components of the accessory 400, such as a processor, power supply, and/or memory. The display component 440 can include an LED display, LCD display, OLED display, e-ink display, AMOLED display, QLED display, or substantially any type of display as desired. Further, although a single display component 440 is shown, the accessory 400 can include multiple display components positioned at any location or locations on the accessory 400 as desired.

As shown, the display component 440 can display various information that may be relevant to a user. For example, the display component 440 can display a volume indicator 441, information related to music or audio that may be playing through earbuds that are associated with the accessory 400, and/or a battery indicator 443 that can be display a state of charge of a battery of the accessory 400 and/or the earbuds associated with the accessory 400. In some examples, the display component 440 can be a touch sensitive display component. Thus, the display component 440 can include a resistive and/or capacitive touch sensitive component that can be operatively coupled to one or more other components of the device. In these examples, the touch sensitive component can allow a user to interact with and provide inputs to the accessory 400. For example, a user can drag a finger over the volume slide 441 shown on the display 440 to change a volume of an acoustic output produced by earbuds associated with the accessory 400. Further examples, of an accessory 400 including a display component 440 are described with respect to FIG. 3C.

Figure 3C:
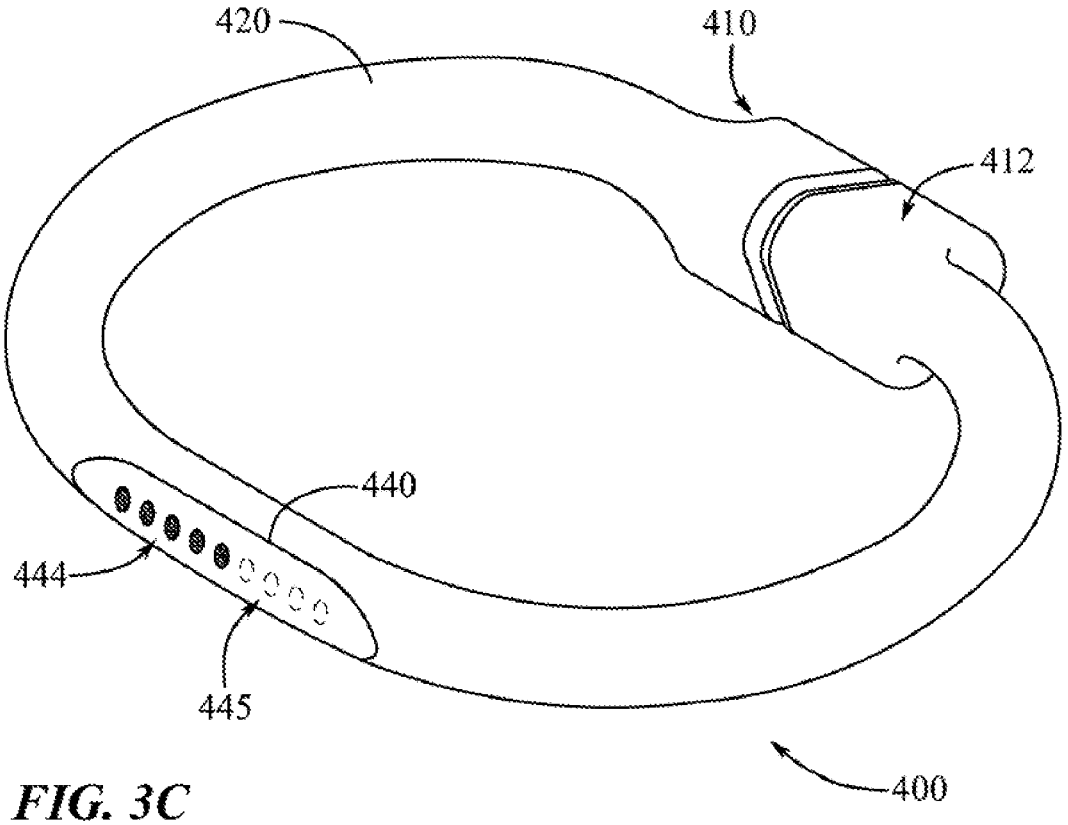
FIG. 3C shows a perspective view of an accessory for wireless earbuds.

FIG. 3C shows a perspective view of an accessory 400 for wireless earbuds including a different display component 440 than shown in the examples described with respect to FIG. 3B. In this example, the display component 440 can include multiple illumination components 444, 445. For example, the display component 440 can include multiple LEDs that can be operatively coupled to one or more components of the accessory 400 and that can be selectively illuminated to provide information to a user. In the present example, illumination components 444 can be illuminated while illumination components 445 may not be illuminated in order to convey to a user a state of charge of a battery, a volume of an acoustic output of associated earbuds, a time remaining in a playing audio file, or any other information as desired. As described with respect to FIG. 3B, the display component 440 can be a touch sensitive display component. Further details and features of an accessory 500 are described with respect to FIG. 3D.

Figure 3D:
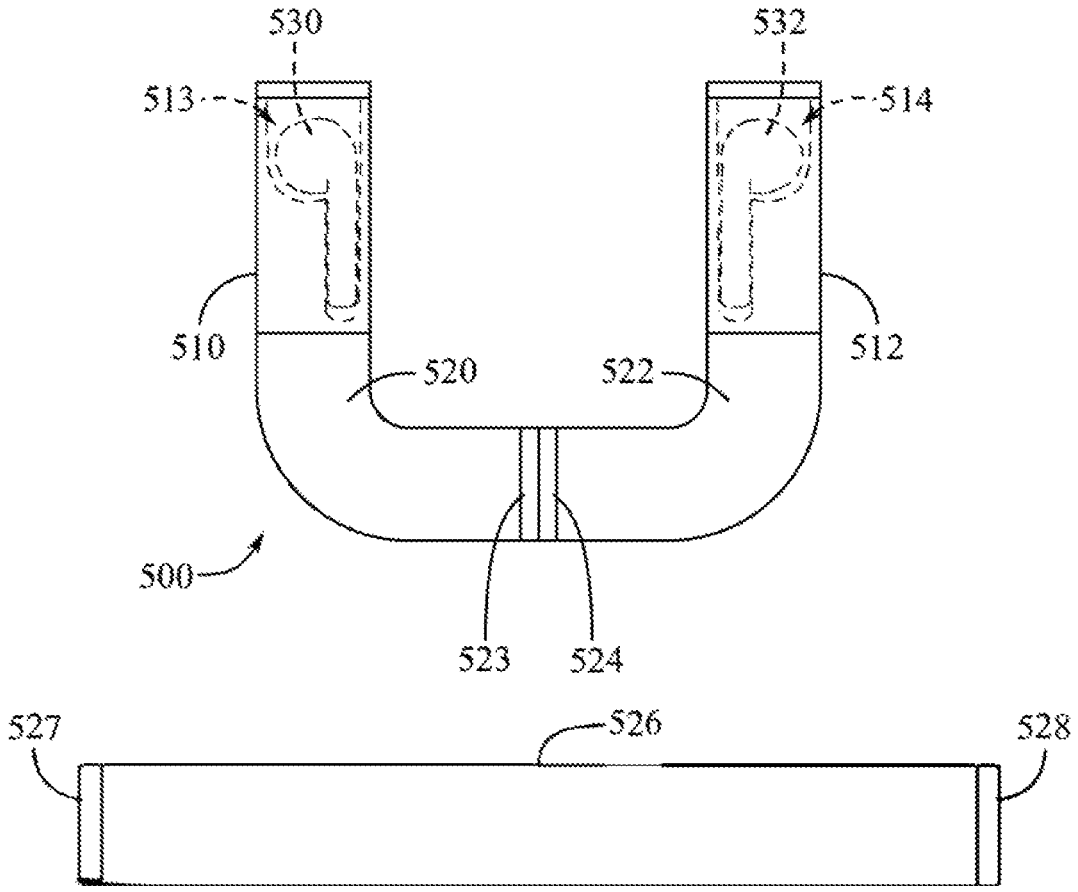
FIG. 3D shows a schematic view of an accessory for wireless earbuds.

FIG. 3D shows a schematic view of an accessory 500 that can be substantially similar to, and can include some or all of the features of the accessories described herein, such as accessories 100, 200, 300, 400. As with accessory 100, the accessory 500 can be designed to receive and retain a pair of wireless earbuds, although the concepts and structure described with respect to the accessory 500 can be used to receive and retain substantially any electronic device or multiple electronic devices, as desired.

The accessory 500 can include a first receiving portion 510 that can define a first cavity 513 sized to receive and/or retain the first earbud 530. The accessory 500 can also include a second receiving portion 512 that can define a second cavity 514 sized to receive and retain the second earbud 532. The first receiving portion 510 is connected or coupled to the second receiving portion 512 by a first flexible portion 520 and a second flexible portion 522. As with the flexible portions described herein, one or both of the flexible portions 520, 522 can define an internal volume and one or more operational and/or electrical components can be disposed therein.

The first flexible portion 520 can further include a first connector 523, while the second flexible portion 522 can include a second connector 524. The first connector 523 can be positioned at an end of the first flexible portion 520 opposite the first receiving portion 510, while the second connector 524 can be positioned at an end of the second flexible portion 522 opposite the second receiving portion 512. In some examples, the first connector 523 and the second connector 524 can be removably attached, connected, or coupled to one another. As shown in FIG. 3D, when the first and second connectors 523, 524 are attached to one another the accessory 500 can function in a substantially similar manner to the other accessories described herein, such as accessories 100, 200, 300, 400. While the first connector 523 and the second connector 524 are illustrated and described as begin positioned at the end of each flexible portion 520, 522 and connected end to end, the first connector 523 and the second connector 524 can be connected in any number of configurations including, but in no way limited to, an overlapping or overlaid connection with the first connector 523 and the second connector 524 positioned in sidewall locations of the flexible portions 520, 522. According to this example, the accessory 500 can be at least partially wrapped along itself and still be connected to form a closed loop for attachment to a desired location. Additionally, the flexible nature of the present accessory 500 allows for the accessory to be wrapped any number of times to function as a bracelet or other accessory, and can have a modified size and shape, depending on the number of loops that are formed. In some examples, additional connectors can be disposed throughout the accessory 500 to facilitate various physical connection sites.

The accessory 500 can also include an extension component 526. The extension component 526 can at least partially define an internal volume and can carry one or more operational and/or electrical components disposed therein. For example, the extension component 526 can include a supplemental battery or batteries disposed in the internal volume. The extension component 526 can be flexible and can include some or all of the features of the flexible portions described herein. The extension component 526 can include a third connector 527 and a fourth connector 528 that can be positioned at opposite ends of the extension component 526. Further details regarding alternate configurations of the accessory 500 including the extension component 526 are described with respect to FIG. 3E.

Figure 3E:
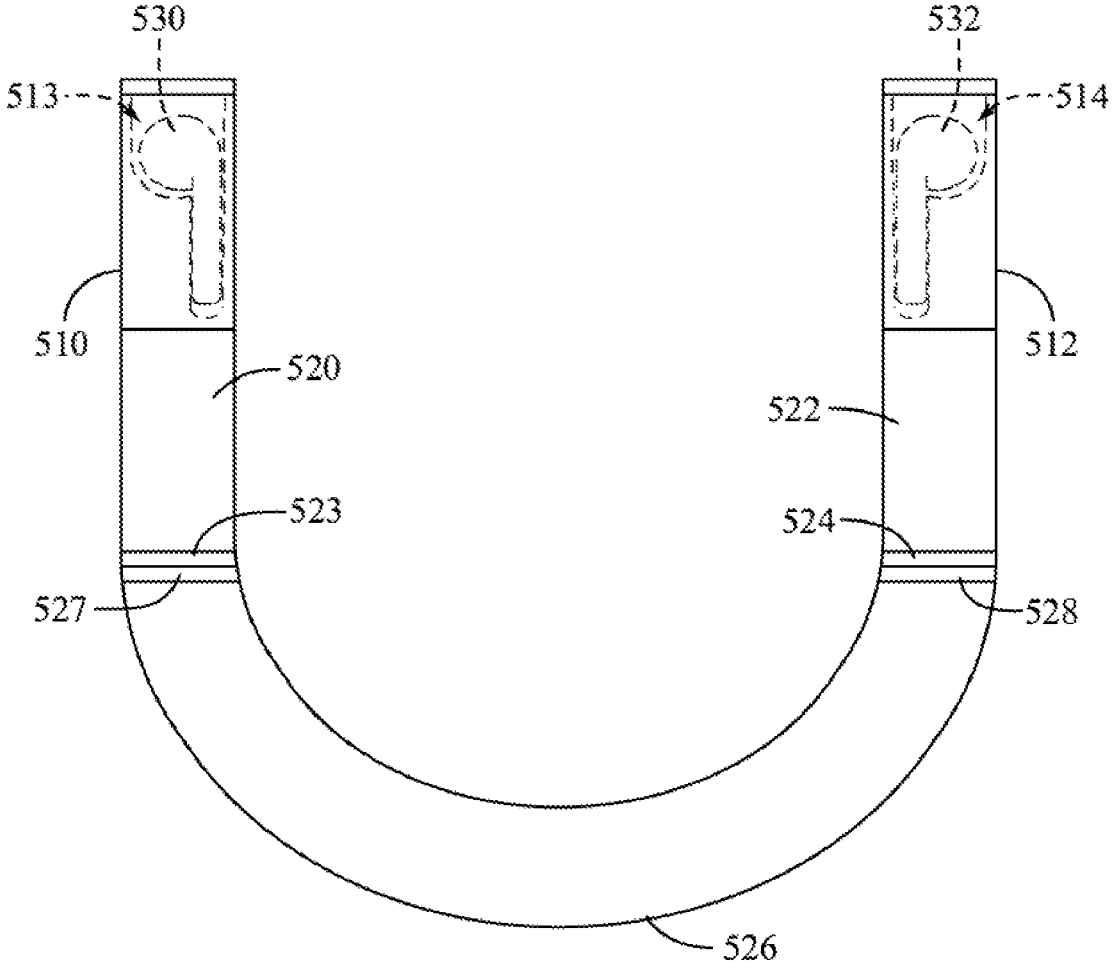
FIG. 3E shows a schematic view of the accessory of FIG. 3D in an alternate configuration.

FIG. 3E shows a schematic view of the accessory 500 in a second or alternate configuration. As shown, in some examples, the first and second connectors 523, 524 can be decoupled from one another. The first connector 523 can be removably attached to the third connector 527 of the extension component 526, while the second connector 524 can be removably attached to the fourth connector 528. In this way, the extension component 526 can extend a length of the flexible portion of the accessory 500. That is, the flexible portion can now include the first flexible portion 520, the extension component 526, and the second flexible portion 522.

In some examples, any operational and/or electrical components disposed in the internal volume of the flexible component 526, such as a battery, can be electrically or operatively coupled to one or more components of the first flexible portion 520, second flexible portion 522, and/or first and second receiving portions 510, 512. In some examples, operational and/or electrical components, such as one or more batteries, of the extension component 526 can be electrically coupled to other components of the accessory 500 through the first, second, third, and/or fourth connectors 523, 524, 527, 528. In this way, the battery life of the accessory 500 can be increased or extended by a user as desired. The extension portion 526 can also allow the accessory 500 to be secured to or around objects that may have been too large for the loop defined by the accessory to surround. For example, the accessory 500 shown in FIG. 3D may be worn as a bracelet by a user as described further herein, while the accessory 500 shown in FIG. 3E may be worn by a user as a necklace.

Any number or variety of components in any of the configurations described herein can be included in the accessory for the portable electronic device. The components can include any combination of the features described herein and can be arranged in any of the various configurations described herein. The structure and arrangement of components of an accessory having a housing with structures described herein, and defining one or more internal volumes and/or cavities, as well as the concepts regarding flexible portions, can apply not only to the specific examples discussed herein, but to any number of examples in any combination. Various examples of accessories including amplification features are described below, with reference to FIGS. 4A-6B.

Figure 4A:
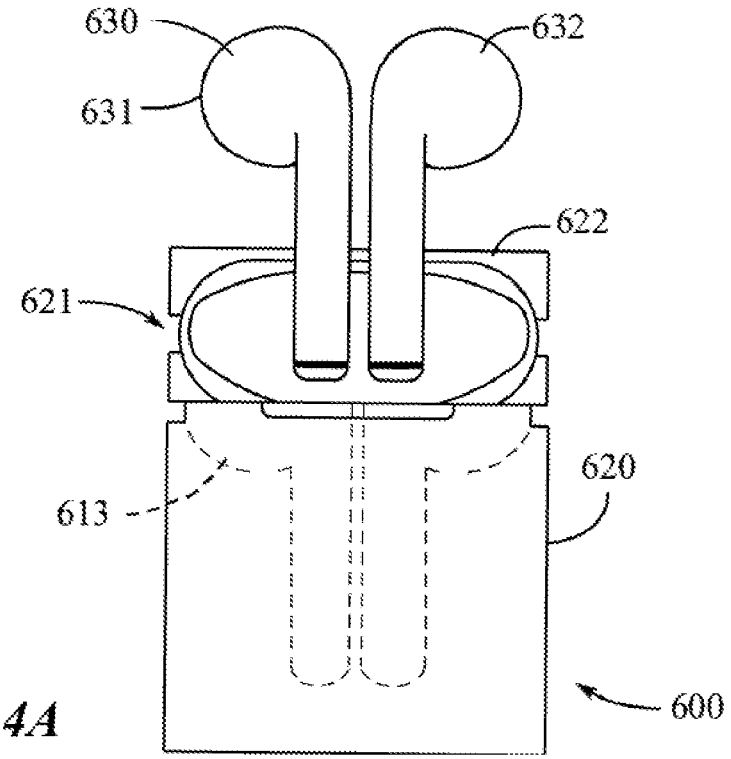
FIG. 4A shows a front view of an accessory and wireless earbuds.

FIG. 4A shows a front view of an accessory 600 that can receive and/or retain an electronic device or devices therein, such as wireless earbuds 630, 632. The accessory 600 can include some or all of the features of the other accessories described herein. The accessory 600 can have a base portion 620 and a lid 622 that can be moveably or rotatably attached to the base portion 620. The base can at least partially define a first cavity 613 sized to receive and/or retain the first earbud 630 and a second cavity 614 that can be sized to receive and/or retain the second earbud 632. In some examples, the lid 622 can also at least partially define the first and second cavities 613, 614. The lid can be rotated or moved between an open position that allow access to the first and second cavities 613, 614, and a closed position wherein the cavities 613, 614 are not accessible.

In some examples, the accessory 600 can include an amplification feature 621. The amplification feature can serve to amplify or increase the volume of an acoustic output produced by one or both of the earbuds 630, 632. In this way, the earbuds 630, 632 and the accessory 600 can cooperate to act as a loudspeaker and can provide an acoustic output at a desirably high volume and fidelity. This can allow a user to listen to an acoustic output from the earbuds 630, 632 when the earbuds 630, 632 are worn in the user's ear, and then store the earbuds 630, 632 in the accessory 600 to produce a loud enough acoustic output that can be heard by multiple users, for example. Additionally or alternatively, if the user is listening to an acoustic output and/or conducting a telephone call while wearing the earbuds 630, 632, but the earbuds 630, 632 run out of battery then the user can store the earbuds 630, 632 in the accessory 600 to simultaneously charge the earbuds 630, 632 and continue listening to the acoustic output and/or conducting the telephone call through the amplification feature 621 of the accessory 600.

In some examples, the amplification feature 621 or amplifier can be a passive amplification feature 621 and/or an active amplification feature 621. Where the amplification feature 621 includes a passive amplification feature 621, the amplification feature 621 can have or define a shape that is configured to amplify the volume of an acoustic output produced by the first and/or the second earbud 630, 632 without the need for additional power to be provided to the amplification feature 621 and/or without the need for the amplification feature 621 to include any moving and/or electronic parts. In some examples, the amplification feature 621 can define an aperture in communication with an ambient environment and the first cavity 613 and/or the second cavity 614. In some examples, the amplification feature 621 can have or define a shape that is configured to amplify the volume of an acoustic output produced by the first and/or the second earbud 630, 632, such as a conical or horn shape.

Where the amplification feature 621 includes an active amplification feature 621, the amplification feature 621 can include one or more mechanical, magnetic, and/or electrical components that can serve to amplify or increase the volume of an acoustic output produced by one or both of the earbuds 630, 632. Additionally, or alternatively, the amplification feature can receive one or more signals, such as audio signals, from the earbuds 630, 632 and/or an electronic device in communication with the earbuds 630, 632 to produce an acoustic output, for example through a transducer or other components. In some examples, the amplification feature 621 can produce a directional acoustic output, and/or can amplify an acoustic output in a directional manner based at least in part on an acoustic output from an earbud. A directional acoustic signal or sound can spread less than a traditionally produced acoustic signal. That is, a directional acoustic signal can be aimed in a particular direction or directions and may only be heard by users in that direction and not by others outside of the desired direction.

In this way, an acoustic signal can be heard by a desired user and not be others even though the desired user may not be wearing earbuds or other in-ear or over-ear audio device. Further details of the accessory 600 are described with respect to FIG. 4B.

Figure 4B:
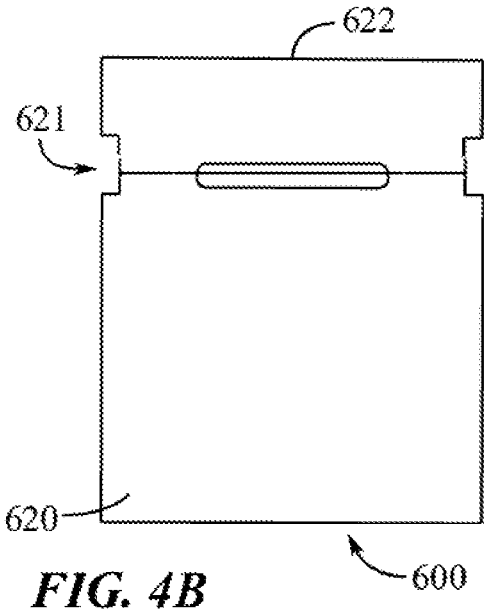
FIG. 4B shows a front view of the accessory of FIG. 4A in an alternate configuration.
Figure 4C:
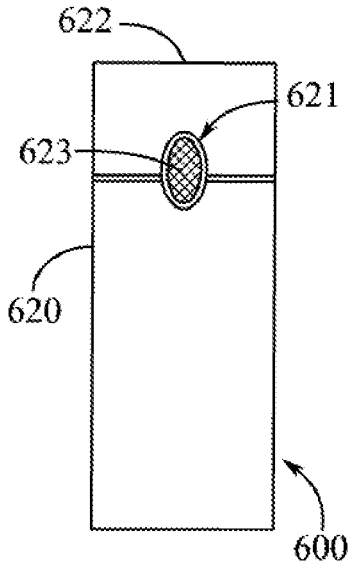
FIG. 4C shows a side view of the accessory of FIG. 4B.

FIG. 4B shows a front view of the accessory 600 in an alternate or closed configuration. As described with respect to the accessories herein, the earbuds 630, 632 can be inserted into the cavities 613, 614 and can be protected and retained therein when the lid 622 is closed. Further, as can be seen in FIG. 4B, in some examples the amplification feature 621 can be part of, or can be defined by both the base 620 and the lid 622. FIG. 4C shows a side view of the accessory 600 including the amplification feature 621. As described with respect to FIG. 4A, in this particular example the amplification feature 621 can include one or more components, such as transducer 623, that can amplify an acoustic output from one or both earbuds 630, 632 and/or that can generate an acoustic output based at least in part on an audio signal provide by the earbuds 630, 632 and/or a device connected to the earbuds 630, 632.

Although the accessory 600 is shown as having a particular shape and configuration, the concepts and components, such as an amplification feature 621, can be included in any of the accessories described herein. Further details of accessories including amplification features and associated components are described with respect to FIGS. 5A and 5B.

Figure 5A:
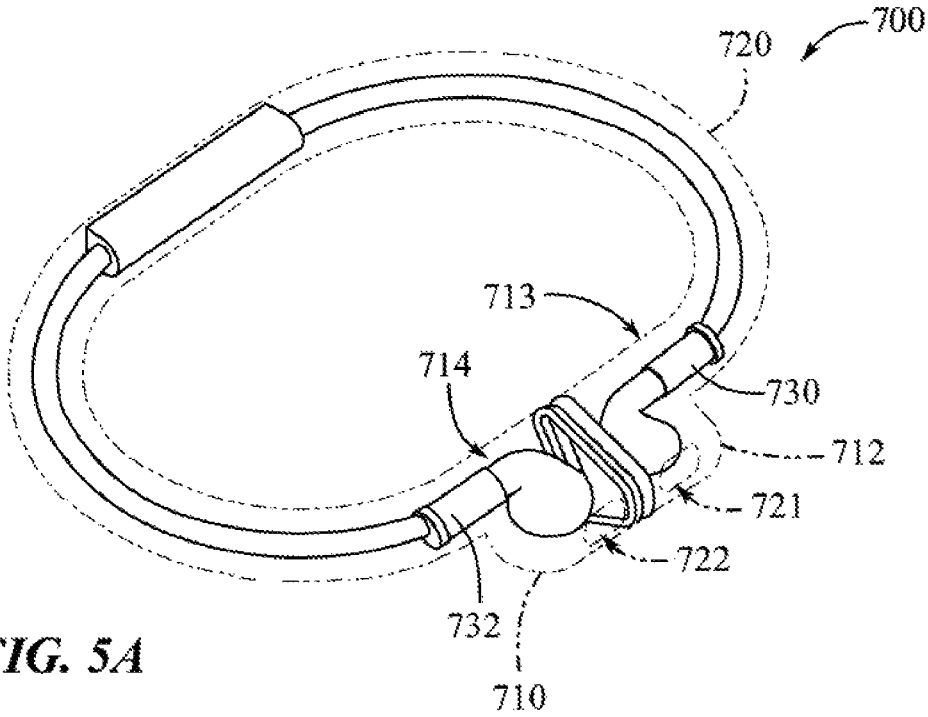
FIG. 5A shows a perspective view of components of an accessory for wireless earbuds.

FIG. 5A shows a perspective view of components of an accessory 700 for wireless earbuds 730, 732. The accessory 700 can be substantially similar to, and can include some or all of the features of the accessories described herein, such as accessory 200. The accessory 700 can include operational components disposed in an internal volume at least partially defined by the flexible portion 720 as described herein. The flexible portion 720 itself is shown in dashed lines. The accessory 700 can include a first receiving portion 710 that can define a first cavity 713 sized to receive and retain the first earbud 730. The accessory can also include a second receiving portion 712 that can define a second cavity 714 sized to receive and retain the second earbud 732. The first receiving portion 710 is connected or coupled to the second receiving portion 712 by a flexible housing portion 720.

In some examples, the first receiving portion 710 can include a first amplification feature 721. In some examples, as described with respect to FIG. 4A, the first amplification feature 721 can include a passive and/or active amplification feature. In some examples, the first amplification feature 721 can have or define a shape that is configured to amplify the volume of an acoustic output produced by the first earbud 730. In some examples, the first amplification feature 721 can define an aperture in communication with an ambient environment and the first cavity 713. Similarly, the second receiving portion 712 can include a second amplification feature 722. The second amplification feature 722 can include a passive and/or active amplification feature. In some examples, the second amplification feature 722 can have or define a shape that is configured to amplify the volume of an acoustic output produced by the second earbud 732. In some examples, the second amplification feature 722 can define an aperture in communication with an ambient environment and the second cavity 714.

Figure 5B:
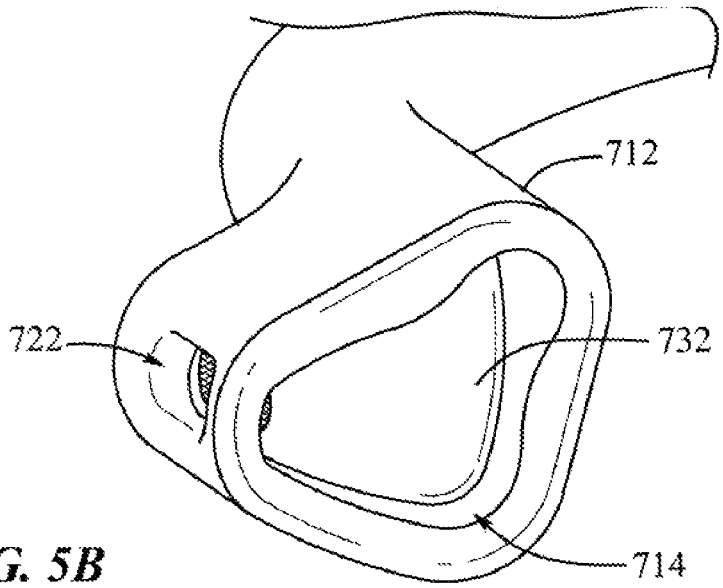
FIG. 5B shows a close-up view of a portion of the accessory of FIG. 5A.

FIG. 5B shows a close-up view of the second receiving portion 710, including the second amplification feature 722. As can be seen, the second amplification feature can define an aperture that is in communication with the ambient environment and the cavity 714, including the second earbud 732 when it is disposed in the cavity 714. Additionally, in some examples, the aperture defined by the second amplification feature 722 can align with a driver or acoustic component of the second earbud 732. Further details of the accessories described herein, including various configurations thereof, are described with respect to FIGS. 6A and 6B.

Figure 6A:
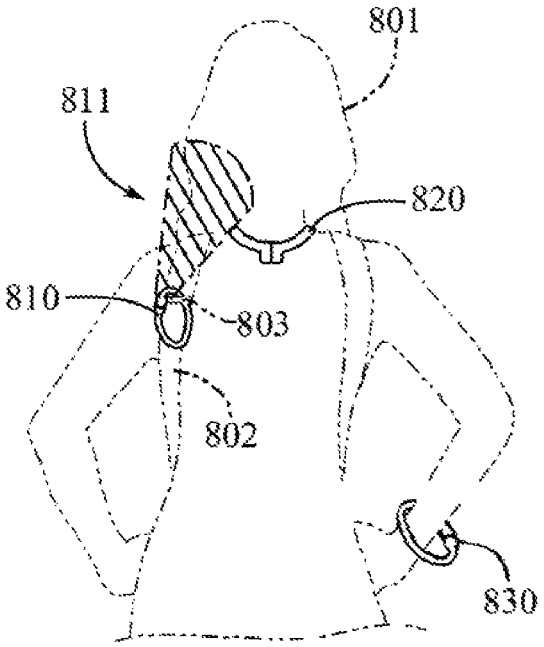
FIG. 6A shows various accessories for wireless earbuds positioned on a user.

FIG. 6A shows a user 801 with various accessories 810, 820, 830 disposed on the user's person and/or attached to the user 801 or clothing or accessories being worn by the user 801. The accessories 810, 820 can be substantially similar to, and can include some or all of the features of the accessories described herein, including a flexible portion that can at least partially define a loop and first and second receiving portions that can be removably attachable to one another to define the loop.

As can be seen, an accessory as described herein can be looped around an article of clothing, accessory, body part or appendage of a user 801, or any other object as desired to retain the accessory thereon. For example, the accessory 810 can be passed through or around a strap or portion of a backpack being worn by the user when the accessory 810 is in an open configuration as shown in FIG. 1B. The accessory 810 can then manipulated into a closed configuration, for example as shown in FIG. 1C, to retain or secure the accessory 810 around the strap. In some examples, an accessory 820 can be positioned adjacent to the user's neck when in an open configuration and can be retained or secured around the user's neck when in a closed configuration, for example in the form of a necklace. Similarly, in some examples, an accessory 830 can be positioned adjacent to the user's wrist when in an open configuration and can be retained or secured around the user's wrist when in a closed configuration, for example in the form of a bracelet.

In some examples, an accessory 810 as described herein can include one or more amplification features. In some examples, the amplification feature or features can be an active amplification feature that can produce a directional acoustic signal 811 as described herein. By producing or amplifying directional sound 811 as shown, the accessory 810 can allow the user 801 to hear the sound 811 while other people, even those standing directly next to the user 801, may not be able to hear the sound 811. In this way, a user 801 can, for example, continue a phone call being conducted through earbuds when the earbuds are in the accessory 810 and can still maintain a desired level of privacy.

Figure 6B:
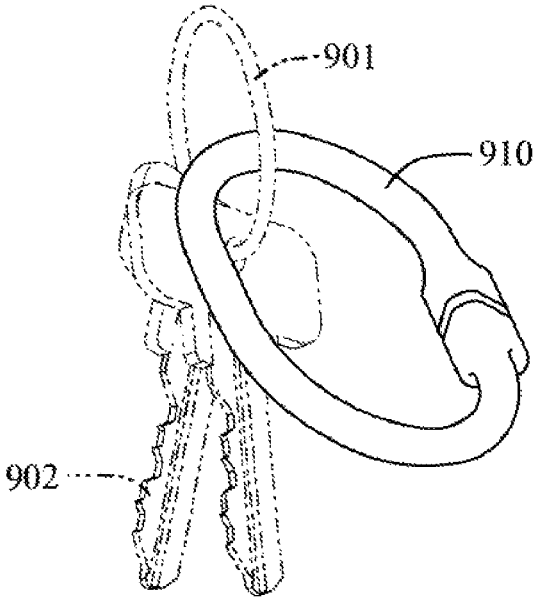
FIG. 6B shows an accessory for wireless earbuds positioned on an item.

FIG. 6B shows an accessory 910 as described herein removably attached or secured to an object 901, such as a keychain or keyring. The accessory 910 can be substantially similar to, and can include some or all of the features of the accessories described herein, including a flexible portion that can at least partially define a loop and first and second receiving portions that can be removably attachable to one another to define the loop. As can be seen, in some examples, the accessory 910 can define a loop that can be removably attached to one or more accessories or objects 901 to allow for convenient storage and transport of the accessory 910 whether it is storing earbuds or other devices, or whether the accessory 910 is empty. In some examples, the material that at least partially defines the exterior surface of the accessory 910, including the silicone material described herein, can allow for a desired level of durability. This material can allow the accessory 910 to withstand everyday use without significant amounts of damage or wear. For example, the accessory 910 can be secured to a keyring 901 that also has keys 902 secured thereto. While in use, the keys 902 may contact the accessory 910, however the durable exterior of the accessory 910 can withstand such contact without showing significant or undesirable levels of wear of damage.

Any of the features or aspects of the accessories discussed herein can be combined or included in any combination. Further, any electronic devices, including headphones, earbuds, smartwatches, or any other portable electronic devices described herein, can be housed entirely or partially within one or more cavities defined by the accessory. For example, one or more portable electronic devices or components thereof can be disposed within a first cavity and a second cavity that are connected by a flexible member or portion.

To the extent applicable to the present technology, gathering and use of data available from various sources can be used to improve the delivery to users of invitational content or any other content that may be of interest to them. The present disclosure contemplates that in some instances, this gathered data may include personal information data that uniquely identifies or can be used to contact or locate a specific person. Such personal information data can include demographic data, location-based data, telephone numbers, email addresses, TWITTER® ID's, home addresses, data or records relating to a user's health or level of fitness (e.g., vital signs measurements, medication information, exercise information), date of birth, or any other identifying or personal information.

The present disclosure recognizes that the use of such personal information data, in the present technology, can be used to the benefit of users. For example, the personal information data can be used to deliver targeted content that is of greater interest to the user. Accordingly, use of such personal information data enables users to calculated control of the delivered content. Further, other uses for personal information data that benefit the user are also contemplated by the present disclosure. For instance, health and fitness data may be used to provide insights into a user's general wellness, or may be used as positive feedback to individuals using technology to pursue wellness goals.

The present disclosure contemplates that the entities responsible for the collection, analysis, disclosure, transfer, storage, or other use of such personal information data will comply with well-established privacy policies and/or privacy practices. In particular, such entities should implement and consistently use privacy policies and practices that are generally recognized as meeting or exceeding industry or governmental requirements for maintaining personal information data private and secure. Such policies should be easily accessible by users, and should be updated as the collection and/or use of data changes. Personal information from users should be collected for legitimate and reasonable uses of the entity and not shared or sold outside of those legitimate uses. Further, such collection/sharing should occur after receiving the informed consent of the users. Additionally, such entities should consider taking any needed steps for safeguarding and securing access to such personal information data and ensuring that others with access to the personal information data adhere to their privacy policies and procedures. Further, such entities can subject themselves to evaluation by third parties to certify their adherence to widely accepted privacy policies and practices. In addition, policies and practices should be adapted for the particular types of personal information data being collected and/or accessed and adapted to applicable laws and standards, including jurisdiction-specific considerations. For instance, in the US, collection of or access to certain health data may be governed by federal and/or state laws, such as the Health Insurance Portability and Accountability Act (HIPAA); whereas health data in other countries may be subject to other regulations and policies and should be handled accordingly. Hence different privacy practices should be maintained for different personal data types in each country.

Despite the foregoing, the present disclosure also contemplates embodiments in which users selectively block the use of, or access to, personal information data. That is, the present disclosure contemplates that hardware and/or software elements can be provided to prevent or block access to such personal information data. For example, in the case of advertisement delivery services, the present technology can be configured to allow users to select to "opt in" or "opt out" of participation in the collection of personal information data during registration for services or anytime thereafter. In another example, users can select not to provide mood-associated data for targeted content delivery services. In yet another example, users can select to limit the length of time mood-associated data is maintained or entirely prohibit the development of a baseline mood profile. In addition to providing "opt in" and "opt out" options, the present disclosure contemplates providing notifications relating to the access or use of personal information. For instance, a user may be notified upon downloading an app that their personal information data will be accessed and then reminded again just before personal information data is accessed by the app.

Moreover, it is the intent of the present disclosure that personal information data should be managed and handled in a way to minimize risks of unintentional or unauthorized access or use. Risk can be minimized by limiting the collection of data and deleting data once it is no longer needed. In addition, and when applicable, including in certain health related applications, data de-identification can be used to protect a user's privacy. De-identification may be facilitated, when appropriate, by removing specific identifiers (e.g., date of birth, etc.), controlling the amount or specificity of data stored (e.g., collecting location data a city level rather than at an address level), controlling how data is stored (e.g., aggregating data across users), and/or other methods.

Therefore, although the present disclosure broadly covers use of personal information data to implement one or more various disclosed embodiments, the present disclosure also contemplates that the various embodiments can also be implemented without the need for accessing such personal information data. That is, the various embodiments of the present technology are not rendered inoperable due to the lack of all or a portion of such personal information data. For example, content can be selected and delivered to users by inferring preferences based on non-personal information data or a bare minimum amount of personal information, such as the content being requested by the device associated with a user, other non-personal information available to the content delivery services, or publicly available information.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

What is claimed is:

1. An accessory for a first and a second wireless earbud, the accessory comprising:

a first receiving portion defining a first cavity sized to receive the first wireless earbud, the first receiving portion comprising a first charging component;

a second receiving portion defining a second cavity sized to receive the second wireless earbud, the second receiving portion comprising a second charging component;

a flexible portion connected to the first receiving portion, the flexible portion comprising a first connector to removably attach the flexible portion to an extension component, the flexible portion at least partially defining an internal volume;

the extension component comprising:

a first end removably attachable to the first connector;

a second end removably attachable to a second connector of the second receiving portion; and a battery disposed in the internal volume and electrically coupled with the first charging component and the second charging component.

2. The accessory of claim 1, wherein:

the first receiving portion comprises a first magnet;

the first charging component comprises an electrical contact disposed in the first cavity;

the second receiving portion comprises a second magnet, to releasably attach to the first magnet;

the second charging component comprises an electrical contact disposed in the second cavity; and the battery comprises a flexible battery.

3. The accessory of claim 1, wherein:

the first charging component comprises a first induction coil; and the second charging component comprises a second induction coil.

4. The accessory of claim 1, further comprising a polymer material molded over the flexible portion, the first receiving portion, and the second receiving portion.

5. The accessory of claim 1, wherein the flexible portion has a substantially constant cross-sectional area.

6. The accessory of claim 1, wherein the flexible portion comprises a touch sensitive component.

7. The accessory of claim 1, wherein the flexible portion comprises a display.

8. The accessory of claim 1, wherein the flexible portion comprises:

a first flexible section attached to the first receiving portion, the first flexible section including the first connector opposite the first receiving portion.

9. The accessory of claim 8, wherein the extension component comprises a supplemental battery disposed in the extension component.

10. The accessory of claim 1, wherein the first receiving portion further comprises an audio amplifier.

11. A wireless earbud charger, comprising:

a first end defining a first earbud cavity sized to receive a first earbud;

a charging component disposed in the first end;

a first attachment feature connected to the first end; and a second end defining a second earbud cavity sized to receive a second earbud and including a second attachment feature, the second attachment feature configured to releasably attach to the first attachment feature;

wherein, when the second attachment feature is attached to the first attachment feature:

the first end occludes the second earbud cavity; and the second end occludes the first earbud cavity.

12. The wireless earbud charger of claim 11, wherein:

the first attachment feature comprises a first magnet; and the second attachment feature comprises a second magnet.

13. The wireless earbud charger of claim 11, further comprising a flexible portion electrically coupled with the charging component, the flexible portion including a battery.

14. The wireless earbud charger of claim 13, wherein the flexible portion further comprises a display.

15. The wireless earbud charger of claim 11, wherein the charging component comprises an inductive coil.

16. The wireless earbud charger of claim 11, further comprising an audio amplifier defined by the first end.

17. An accessory for wireless earbuds, the accessory comprising:

a first end defining a first earbud cavity, the first end comprising:

a first earbud charging component;

a first magnetic coupler; and a first audio amplification feature defining a shape configured to amplify a sound from a first earbud;

a second end defining a second earbud cavity, the second end comprising:

a second earbud charging component;

a second magnetic coupler; and a second audio amplification feature defining a shape configured to amplify a sound from a second earbud;

a flexible portion connected to the first end and the second end, the flexible portion defining an internal volume; and a battery disposed in the internal volume and electrically coupled with the first earbud charging component and the second earbud charging component.

18. The accessory of claim 17, wherein at least one of the first audio amplification feature or the second audio amplification feature comprises a passive amplification feature.

19. The accessory of claim 17, further comprising an electrical component disposed in the internal volume.

20. The accessory of claim 19, wherein the accessory comprises a loop when the first magnetic coupler is attached to the second magnetic coupler.

* * * * *